US006960261B2

(12) United States Patent
Westermann

(10) Patent No.: US 6,960,261 B2
(45) Date of Patent: Nov. 1, 2005

(54) APPARATUS FOR APPLYING FLUID

(75) Inventor: Peter Westermann, Berkel-Enschot (NL)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/696,107

(22) Filed: Oct. 29, 2003

(65) Prior Publication Data

US 2004/0134623 A1 Jul. 15, 2004

(30) Foreign Application Priority Data

Oct. 30, 2002 (DE) ..... 202 16 794 U

(51) Int. Cl.[7] ..... B05C 3/02
(52) U.S. Cl. ..... 118/411; 412/37
(58) Field of Search ..... 118/410, 419, 118/411, 412, 503, 323, 315, 316; 425/466, 461, 467, 382.4; 156/578, 908; 412/37

(56) References Cited

U.S. PATENT DOCUMENTS 4,248,579 A * 2/1981 Maejima ..... 425/227
5,271,794 A 12/1993 Jarrell et al. ..... 156/578
5,424,018 A * 6/1995 Paul et al. ..... 264/176.1
5,456,869 A * 10/1995 Miles et al. ..... 264/39
5,516,545 A * 5/1996 Sandock ..... 427/96.9
5,575,851 A * 11/1996 Abe et al. ..... 118/410
5,846,599 A * 12/1998 Innes et al. ..... 427/209
5,893,951 A * 4/1999 Madrzak et al. ..... 118/413
6,053,978 A * 4/2000 Bernert ..... 118/325
6,376,012 B1 * 4/2002 Innes et al. ..... 427/209
6,423,144 B1 * 7/2002 Watanabe ..... 118/669
6,565,660 B1 * 5/2003 Wagner et al. ..... 118/673
6,695,031 B1 2/2004 Baltensperger

FOREIGN PATENT DOCUMENTS

EP 1 156 931 1/2003
WO WO 00/02667 * 1/2000

* cited by examiner

*Primary Examiner*—Brenda A. Lamb
(74) *Attorney, Agent, or Firm*—Wood, Herron & Evans, L.L.P.

(57) ABSTRACT

An apparatus for applying fluid onto a substrate, in particular for glueing inner books, books, magazines and other substrates that need to be bound. The apparatus comprises a first slot nozzle, connectable with a fluid source, for applying a fluid film onto one side of the substrate to be coated. The first slot nozzle comprises a seal member for adjusting the width of the first slot nozzle outlet transversely to the principal direction of movement of the substrate. This enables the width across which fluid is applied to the inner book side to be adjusted.

7 Claims, 2 Drawing Sheets

APPARATUS FOR APPLYING FLUID

FIELD OF THE INVENTION

The present invention relates to apparatus for applying fluid to a substrate and, more specifically, to apparatus utilizing slot nozzles to apply film coatings.

BACKGROUND OF THE INVENTION

In particular, the invention relates to apparatus for glueing inner books. When reference is made in the context of this invention to a "book" or an "inner book" the terms shall be understood to mean that substrate in which one or several leaves or pages of a material that can be written upon, for example paper or films, are joined with an adhesive bond to a binding made, for example, of paper, cardboard or film. In particular, the term includes books in the conventional sense, as well as bound magazines, catalogs and the like.

Conventionally, an adhesive bond is used to bind material written upon and its binding or cover. The adhesive is often applied directly onto the spine of the book or onto the side of the inner book by means of roller applicator systems. However, one unwanted effect produced in many cases is that the adhesive is not applied uniformly and that the adhesive is squeezed out at the edges of the inner book when the applicator rollers compress the inner book. Moreover, in the roller trough of the roller applicator systems, bubbles are often produced in the adhesive, leading to foaming of the adhesive and to high costs for cleaning.

Attempts have also been made to apply the adhesive to an inner book through spray nozzles. This method, too, results in the uniformity of adhesive application often being unsatisfactory. Another frequent occurrence is local swelling of the book sides and thickening caused by droplets of adhesive, with the result that spines become rounded and the stacking of books is hampered. In addition, a significant portion of the adhesive or its solvent evaporates on spray application, leading to persistent contamination of a bookbinding workplace with chemicals that are damaging to health.

An apparatus for glueing inner books is known from U.S. Pat. No. 5,271,794 (the '794 patent) which comprises slot nozzles for applying adhesive to opposite sides of an inner book. The slot nozzles disclosed in the '794 patent are designed to contact the spine to be coated. When using the slot nozzles proposed in the '794 patent, adhesive can only be applied with the same width at all times (viewed transversely to the principal direction of movement of the inner books to be glued).

The object of the present invention was therefore to provide an apparatus for applying fluid onto a substrate, with which the disadvantages described in the foregoing can be mitigated or entirely avoided.

SUMMARY OF THE INVENTION

Thus, according to the invention, an apparatus is proposed for applying fluid to a substrate, and in particular for glueing inner books. The substrate is movable in a principal direction of movement relative to the apparatus, and the apparatus comprises a first slot nozzle connectable with a fluid source for applying a fluid film onto a side of the substrate to be coated. The first slot nozzle comprises a movable seal member for adjusting the width of the first slot nozzle outlet transversely to the principal direction of movement of the substrate.

In the context of this invention, a "side" or "side surface" is understood to be a substantially smooth surface of the substrate to be glued. Thus, when adhesive is to be applied to inner books, the side to receive adhesive from the first slot nozzle is not the spine, head, foot or front edge comprised of the collective page edges, but rather the first or the last page or side surface of the inner book.

By providing the movable seal member, the apparatus according to the invention enables advantageously easy adjustment of the width of fluid application on the substrate to be coated. The term "width" does not refer here to the length of the inner book from the head to the foot thereof, but rather the gap, which can be varied by the movable seal member, between the laterally delimiting edges of the slot nozzle outlet in the longitudinal direction of the slot. When glueing an inner book, the gap will appropriately correspond to the space between that edge of the applied fluid film applied in the direction of the spine of the book and the opposite fluid film edge.

The apparatus according to the invention also permits optimal application of the fluid onto the sides of the substrate to be coated. In particular, any squeezing out of the fluid at the edges of the substrate, for example at the head and foot of an inner book, is prevented.

The apparatus according to the invention is particularly suitable for applying adhesive, preferably dispersion adhesives (cold glues), hot-melt adhesives, twin-component adhesives (primer-two-shot) and polyurethane (PUR) adhesives.

An apparatus according to the invention for applying fluid onto a substrate, wherein the apparatus comprises only a first slot nozzle, is particularly suitable for preparing a bond between the substrate and a cover on one side only, in the manner of Swiss brochure binding. However, what is preferred is an apparatus that additionally comprises a second slot nozzle, connectable with a fluid source, for applying a fluid film onto that side of the substrate to be coated which lies opposite the side that can be coated with fluid by the first slot nozzle. In particular, such an apparatus permits both opposite sides of an inner book to be coated with an adhesive.

A particularly preferred embodiment is one in which the second slot nozzle comprises a second movable seal member for adjusting the width of the second slot nozzle outlet transversely to the principal direction of movement of the substrate. In such an embodiment, therefore, the first and second slot nozzles resemble each other at least to the extent that the width of their nozzle outlets are adjustable. This makes it possible to coat the substrate on both opposite sides with fluid films that are respectively of preselected width. With such an apparatus, it is possible, especially, to provide books with inside front and back flaps in leporello style.

The widths of the first and second slot nozzle outlets can be adjusted independently of each other; however, the apparatus can be appropriately configured for simultaneously setting the width of the first and the second slot nozzle outlets.

According to the invention, what is also proposed is an apparatus that additionally comprises a third slot nozzle, connectable with a fluid source, for applying fluid film onto a back surface of the substrate to be coated. It is very desirable, especially when glueing inner books, if a single piece of equipment enables adhesive to be applied not only to the back surface (spine), but also to one or both sides of an inner book. Inner books glued in this way lend themselves particularly well to the production of paperback and/or hard-cover books. It is not necessary, but nevertheless expedient in such cases if, in addition to a first slot nozzle, the apparatus according to the invention also comprises a second slot nozzle for applying a fluid film onto one side of the substrate to be coated. A particularly preferred embodiment is one in which the second slot nozzle includes a second movable seal member for adjusting the width of the slot nozzle outlet transversely to the principal direction of movement of the substrate. In this way, it is possible in a single apparatus to apply the fluid not only to the back surface or spine of a book but also to both adjacent sides of the substrate to be coated.

In a preferred embodiment, the first and/or any second slot nozzle is movably mounted for adjusting the gap between the first and second slot nozzle. This enables the apparatus, in an advantageously simple manner, to be adapted to different thicknesses of substrate to be coated. Of course, both alternative apparatuses in which a second slot nozzle is provided are only an option when such a second slot nozzle is present in the apparatus in the first place; otherwise, the slot nozzle configuration as described relates to the first slot nozzle only. This diction will be maintained accordingly in the following.

Particularly preferred embodiments are such apparatuses in which the first slot nozzle, as well as the second slot nozzle if present, is adjusted to contact the substrate to be coated. This means that contact nozzles, not spray nozzles, are used in such apparatuses. In this manner, a particularly uniform application of the fluid is achieved, and the formation of unwanted fluid droplets on the sides of the substrate to be coated is largely or entirely avoided. This also avoids evaporation of solvents that may be contained in the fluid, and hence contamination of a bookbinding workplace with undesired chemicals.

The apparatus can be provided, in particular, with springs for pressing the slot nozzle against the substrate to be coated. In this way, it is possible to generate a uniform application pressure from the slot nozzles and compensate for slight variations in the thickness of the substrate to be coated.

In a particularly preferred embodiment, the movable seal members projects out of the plane of the first nozzle outlet and/or the plane of any second nozzle outlet, if present, in the direction of a substrate to be coated, in order to limit the thickness of the fluid film applied by the respective slot nozzle onto the substrate.

By virtue of the outwardly projecting seal members it is possible, in an advantageously simple manner, not only to produce a good contact with the substrate to be coated but also to adjust with high precision the gap between the plane of the nozzle outlet and the substrate to be coated so that the thickness of the fluid film applied to the substrate is constant.

The seal members of the first and/or any second slot nozzle appropriately comprises a movable slider that extends into and/or in front of the plane of the respective slot nozzle outlet (in the same direction of the substrate to be coated, downstream from a fluid emanating from the plane of the slot nozzle outlet in operation). A slider makes it particularly easy to adjustably limit the maximum width of a slot nozzle outlet. In addition, sliders permit a particularly good seal between the slot nozzle and the substrate to be coated, such that unwanted traces of fluid on the substrate can be largely or entirely avoided.

Alternatively, a preferred embodiment is one in which the seal members extends within the plane of the first and/or any second slot nozzle, without projecting out of the respective plane of the slot nozzle outlet. In that case, the seal members appropriately comprises a slider whose edge on the outlet side defines a plane with the opposite edge on the outlet side of the slot nozzle body, the plane being identical to the plane of the slot nozzle outlet. In an advantageous manner, such embodiments prevent different pressures from being exerted at the edges of the slot nozzle on the substrate to be coated.

However, another preferred apparatus is one in which the first slot nozzle and/or second slot nozzle, if present, and/or third slot nozzle, if present, comprise(s) a fluid passageway extending across the entire width of the slot nozzle. A piston moves in the fluid passageway to seal the fluid passageway. A sealing body extends into the plane of the slot nozzle outlet. The piston and the sealing body cooperate to adjust the width of the slot nozzle outlet transversely to the principal direction of movement of the substrate. In such an embodiment it is possible, in an advantageously simple manner, to limit the width of the slot nozzle not only at its outlet, but also deep inside the respective slot nozzle body itself. In this way, it is possible to avoid the formation, upstream from the plane of the slot nozzle outlet, of dead spaces in which the fluid being applied to the substrate could otherwise accumulate and obstruct the flow. Unless a piston and a sealing body cooperating therewith are provided, hot-melt adhesive, for example, might flow only slowly or not at all in the direction of the substrate to be coated, in those areas that are located upstream from the slot nozzle outlet which is partly limited (covered over, for example) by the movable seal members. The risk would then ensue that the adhesive flowing slowly or not at all within the body of the slot nozzle will harden and permanently clog the slot nozzle. These risks can be totally excluded for all practical purposes with the embodiment according to the invention.

A particularly preferred apparatus is one in which the width of the third slot nozzle outlet is limited by the gap between the first and second slot nozzle. "Width" refers here to the dimension of the third slot nozzle in the direction from one side of the substrate to the opposite side of the substrate. When the substrate to be coated is an inner book, then the width is the dimension of the third slot nozzle in the direction of the thickness of the book's spine. Hence, the width of the third slot nozzle outlet can be adjusted particularly easily to the thickness of the substrate to be coated, in particular to the thickness of an inner book to be glued. Particularly when the first and the second slot nozzle are adjusted to touch the substrate to be coated, it is easy to limit the width of the third slot nozzle outlet in this way by positioning each of the first and the second slot nozzles in a body that partly covers and seals the maximum width of the third slot nozzle outlet. This means, in particular, that the only portion of the maximum width of the third slot nozzle outlet that can be left open by the body of the first and second slot nozzle is that portion which is equal to the thickness of the back surface or spine of the substrate to be coated.

Another preferred apparatus is one that includes a clamping device for holding the movable substrate. Particularly, when the substrate to be coated comprises several layers, such as leaves or pages of a book, the swelling of the substrate and the enclosure of fluid between the layers of the substrate can be prevented by the clamping device.

It is particularly expedient in such cases when the apparatus additionally comprises a lifting device which moves the first slot nozzle and/or any second slot nozzle and/or any third slot nozzle in the direction of the clamping device. In this way, the slot nozzles can be moved in order to adapt them to different sizes of substrate to be coated. In this manner, a fluid film applied to a substrate is always positioned at the same distance from the substrate spine, even at varying sizes of substrate to be coated.

In a further preferred embodiment of the invention, the apparatus additionally comprises a control device that communicates with at least one of the slot nozzles and a device for recognizing the end of a substrate, in order to control the flow of fluid out of the slot nozzle depending on the presence in the area of the slot nozzles of a substrate to be coated. The control device thus enables the discharge of fluid onto a substrate to begin as soon as the substrate is positioned in the direction of such discharge in front of the outlet of the respective slot nozzle, and the discharge of fluid to end as soon as there is no substrate positioned in the direction of discharge in front of the outlet of the respective slot nozzle. With such a control device, the fluid available for application to the substrate can be maximized. In particular, it is possible to prevent the escape of fluid from the slot nozzle even though no substrate to be coated is present in the slot nozzle area, which would otherwise lead to unwanted fluid discharge on the apparatus and to waste of fluid. It is particularly expedient in this case when the control device communicates with the first, second and third slot nozzle, insofar as any second and/or third slot nozzle is present, in order to control the discharge of fluid such that it depends on the presence of a substrate to be coated being present in the area of the slot nozzle.

BRIEF DESCRIPTION OF THE DRAWINGS

Below, the invention is described in greater detail with reference to preferred embodiments and to the drawings in the figures.

DETAILED DESCRIPTION OF THE DRAWINGS

Figure 1:
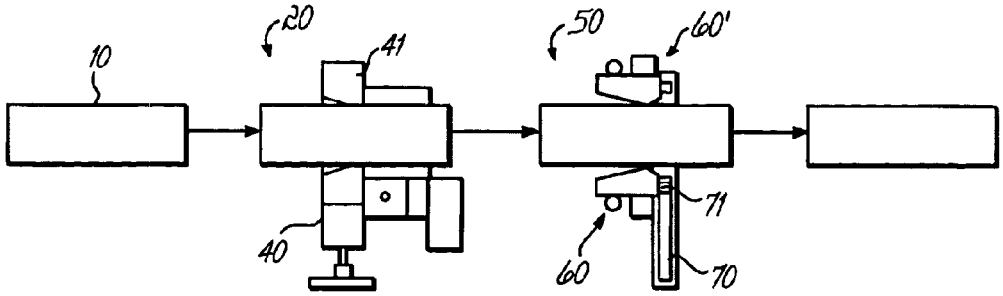
FIG. 1 is a schematic plan view of a bookbinding line.

FIG. 1 provides a schematic plan view of a bookbinding line. The bookbinding line comprises a spine glueing apparatus 20 and an apparatus for glueing book sides 50. Here, the spine glueing apparatus 20 and the apparatus for glueing book sides 50 are shown separated from each other, although in fact they form a single apparatus. Both devices shall now be described in greater detail with reference to FIGS. 2 and 3.

When a bookbinding line is in operation, an inner book 10 shown in FIG. 1 as coming from the left is introduced into a spine glueing apparatus 20 in order to glue the spine of the book. The inner book 10 is then conveyed further into the apparatus for glueing book sides 50, shown to the right of the spine glueing apparatus 20 in FIG. 1. In the apparatus for glueing book sides 50, glue is applied to the sides of the inner book 10. Once inner book 10 has been glued, it is then removed from the apparatus for glueing book sides 50.

Figure 2:
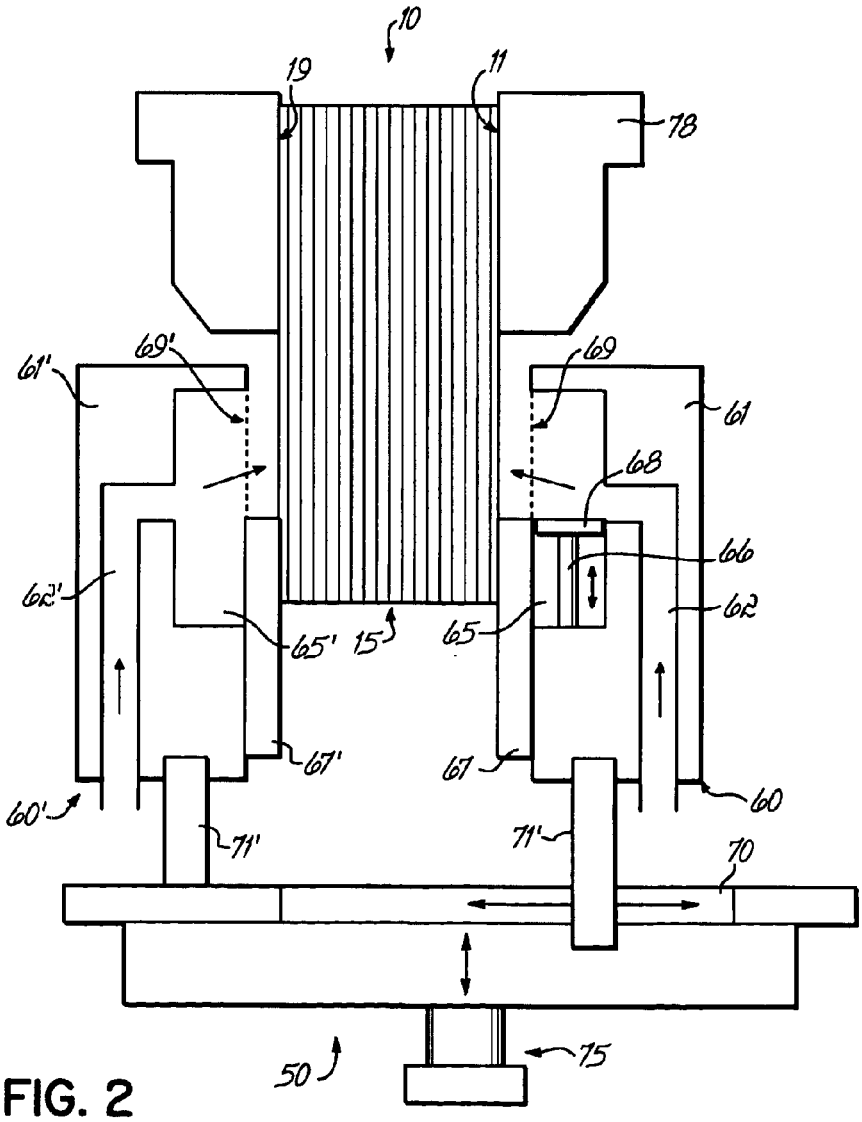
FIG. 2 is a schematic side elevation view of an apparatus for glueing book sides of a bookbinding line pursuant to FIG. 1.

FIG. 2 is a schematic side elevation view of an apparatus for glueing book sides 50, as used in the bookbinding line pursuant to FIG. 1.

FIG. 2 also depicts a piston 66 and a sealing body 68 disposed in fluid passageway 65. The piston 66 and sealing body 68 are moveable within passageway 65 to selectively seal off a portion of the passageway. For example, piston 66 and sealing body 68 may be moved within passageway 65 to seal off the portion of passageway 65 directly behind slider 67 to prevent the formation of dead space where fluid could accumulate.

The apparatus for glueing book sides 50 has a first slot nozzle 60 and a second slot nozzle 60'. Slot nozzles 60, 60' each have a body member 61, 61'. A fluid supply channel 62, 62' is disposed in each of the body members 61, 61'. Slot nozzles 60, 60' are each connected to a fluid source (not shown) via fluid supply channels 62, 62'. Each slot nozzle 60, 60' also has a fluid passageway 65, 65' inside its respective body member 61, 61'. Fluid passageways 65, 65' are each connected to fluid supply channels 62, 62'. Slot nozzles 60, 60' are disposed opposite each other and accommodate an inner book 10, shown here in cross-section, having outer sides 11, 19 lying in the same direction and onto slot nozzles 60, 60'. Fluid passageways 65, 65' of slot nozzles 60, 60' each have outlets in the form of slits on the side respectively facing the inner book 10. Each slit-like outlet of slot nozzles 60, 60' is partly covered by a movable slider 67, 67' extending between the body 61, 61' of the respective slot nozzle 60, 60' and the inner book 10. Sliders 67, 67' each have contact with an area on the respective sides 11, 19 of inner book 10. Sliders 67, 67' each limit the maximum width of the slot nozzle outlet 60, 60' to an adjustable outlet width 69, 69'.

The first slot nozzle 60 shown on the right in FIG. 2 is disposed such that it is laterally movable by means of a carriage 71 on a rail 70, such that the gap between the first slot nozzle 60 and the second slot nozzle 60' can be adjusted to accommodate the thickness of the inner book 10.

Inner book 10 is held between slot nozzles 60, 60' by means of a retaining clamp 78. Slot nozzles 60, 60' are connected to a lifting device 75 such that they can be moved towards or away from retaining clamp 78.

Figure 3:
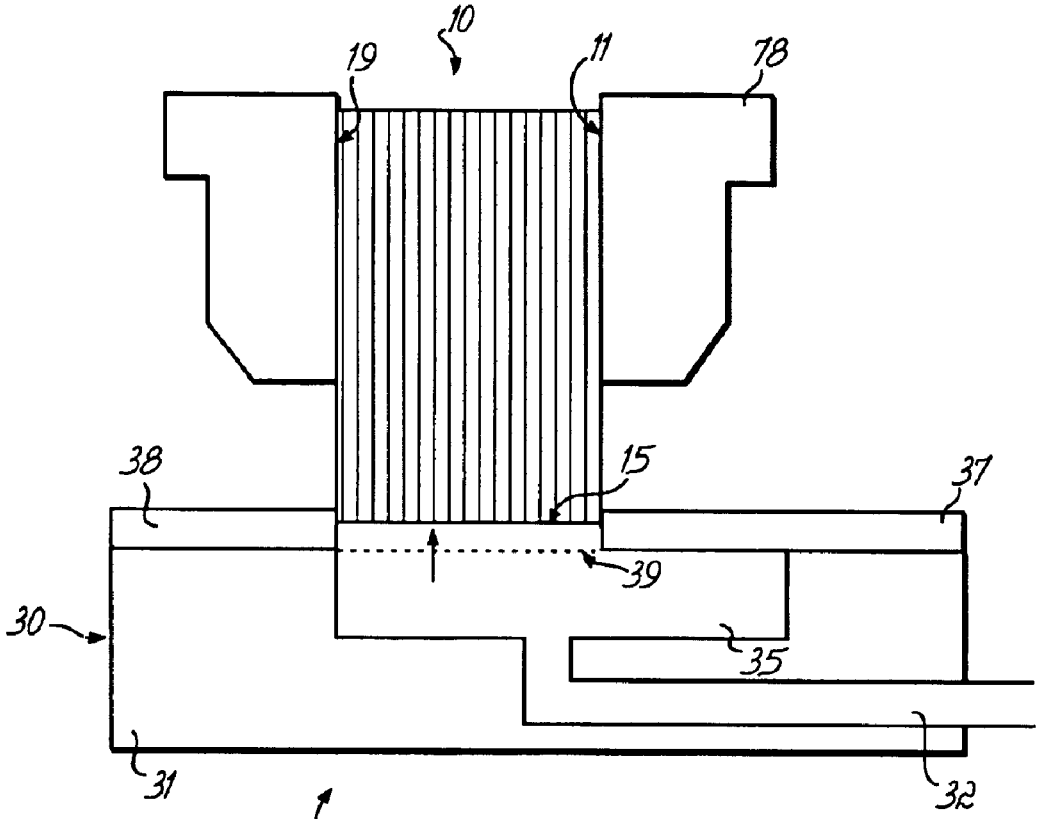
FIG. 3 is a schematic side elevation view of a spine glueing apparatus of a bookbinding line pursuant to FIG. 1.

FIG. 3 similarly shows, in a schematic side elevation view, a cross-section through a spine glueing apparatus 20 pursuant to FIG. 1. Spine glueing apparatus 20 has a slot nozzle 30 with a body member 31. Inside body member 31, a fluid supply channel 32 is defined that opens into a fluid passageway 35 and is connected to a fluid source (not shown). Fluid passageway 35 has an outlet in the form of a slit across its entire width. In the direction of discharge from the outlet of fluid passageway 35, a slider 37 is disposed. Slider 37 partly covers the slit-shaped outlet of fluid passageway 35 and leaves only an aperture 39 uncovered. On the side of body 31 opposite slider 37, adjacent to aperture 39 of slot nozzle 30, a cover plate 38 of the same thickness as slider 37 is disposed. A spine 15 of an inner book 10 projects into the area between the opposite edge of slider 37 and cover plate 38, that is, into the area of aperture 39. The spine 15 is formed by the edges of leaves 12 of inner book 10. Inner book 10 is held with its back 10 in the area of aperture 39 by means of a retaining clamp 78. Inner book 10 is held at the sides by lateral guides 40, 41 (see FIG. 1). The lateral guides 40, 41 may be defined, in particular, by the bodies 61, 61' of slot nozzles 60, 60'.

When a bookbinding line according to the invention, as shown in FIG. 1, is in operation, the backs 15 of inner books 10 are firstly glued in the spine glueing apparatus 20. To this end, an inner book 10 is secured in a retaining clamp 78 and moved into the area between lateral guides 40, 41 of the spine glueing apparatus 20. A sensor (not shown) in the form of a photoelectric barrier recognizes that the spine 15 is positioned in the area of aperture 39 of slot nozzle 32 and supplies a signal to that effect to the control device (not shown). The control device initiates the forced transport of an adhesive from the fluid source (not shown) through fluid supply channel 32 into fluid passageway 35 and through aperture 39 thereof towards the spine 15 of inner book 10. Inner book 10 is moved along its length, that is to say in the principal direction in which its spine 15 extends, over aperture 39 of slot nozzle 30, in order to coat the entire spine 15 with adhesive.

After the spine 15 of the inner book 10 has been coated with adhesive, the inner book 10 is moved on to the apparatus for glueing book sides 50 and is introduced between slot nozzles 60, 60'. As soon as inner book 10 has reached the area between slot nozzles 60, 60', a corresponding signal is supplied to the control device by a sensor provided in the form of a photoelectric barrier (not shown). The control device (not shown) then causes adhesive to be forcibly conveyed from the fluid source through the fluid supply channels 62, 62' into fluid passageways 65, 65'. Under the pressure of forced conveyance, the adhesive is extruded from outlets 69, 69' and is applied to sides 11, 19 of inner book 10. As already occurred in the spine glueing apparatus 20, inner book 10 is drawn along its length between slot nozzles 60, 60', such that an adhesive strip is applied to sides 11, 19 of inner book 10 along their length. By moving sliders 67, 67', the width of outlets 69, 69' of slot nozzles 60, 60' can be modified. In this way, the width of the adhesive film applied to sides 11, 19 of inner book 10 is adjusted.

In order to adapt the apparatus for glueing book sides 50 to different sizes of book, the lifting device 75 can be operated such that slot nozzles 60, 60' are moved in the direction of, or away from the retaining clamp 78. In this way, the gap between the inner book edge (spine edge) shown at the bottom of FIG. 2 and the upper end of the adhesive film applied from slot nozzles 60, 60' can also be adjusted.

What is claimed is:

1. Apparatus for applying fluid to a substrate movable in a principal direction of movement comprising:

a first slot nozzle capable of receiving the fluid from a fluid source and including a first slot nozzle outlet lying in a plane and having a width adapted to extend transversely to the principal direction of movement for applying a first fluid film onto a side of the substrate to be coated, a second slot nozzle having a second slot nozzle outlet lying in a plane and capable of receiving the fluid from the fluid source and applying a second fluid film onto a side of the substrate to be coated that lies opposite the side coated with the first fluid film, first and second fluid passageways respectively communicating between said fluid source and said first and second slot nozzle outlets, a first movable seal member positioned entirely outside of said first fluid passageway for adjusting the width of said first slot nozzle outlet transversely to the principal direction of movement of the substrate, a second movable seal member positioned entirely outside of said second fluid passageway for adjusting the width of said second slot nozzle outlet transversely to the principal direction of movement of the substrate, a piston movable in said fluid passageway of at least one of said first and second slot nozzles to seal said fluid passageway, and a sealing body extending within the plane of said slot nozzle outlet of said at least one of said first and second slot nozzles, said piston and sealing body cooperating to adjust the width of said slot nozzle outlet transversely to the principal direction of movement of the substrate.

2. The apparatus of claim 1 wherein said first and second slot nozzles are movably mounted for adjusting a gap between said first and second slot nozzles.

3. The apparatus of claim 1, wherein said first movable seal member projects out of said plane in a direction of the substrate to be coated, in order to limit the thickness of the fluid film applied by said first slot nozzle onto the substrate.

4. Apparatus for applying fluid to a substrate movable in a principal direction of movement comprising:

a first slot nozzle capable of receiving the fluid from a fluid source and including a first slot nozzle outlet having a width adapted to extend transversely to the principal direction of movement for applying a first fluid film onto a side of the substrate to be coated, and a fluid passageway communicating between said fluid source and said first slot nozzle outlet;

a first movable seal member disposed outside of said fluid passageway for adjusting the width of said first slot nozzle outlet transversely to the principal direction of movement of the substrate;

a second slot nozzle having a second slot nozzle outlet and capable of receiving the fluid from the fluid source and applying a second fluid film onto a side of the substrate to be coated that lies opposite the side coated with the first fluid film;

a second movable seal member for adjusting the width of said second slot nozzle outlet transversely to the principal direction of movement of the substrate; and a third slot nozzle having a third slot nozzle outlet and capable of receiving the fluid from the fluid source and applying a third fluid film onto a third surface of the substrate.

5. The apparatus of claim 4, wherein said third slot nozzle outlet has a width and a gap is defined between said first and second slot nozzles, the width of said third slot nozzle outlet being limited by the gap between said first and second slot nozzles.

6. The apparatus of claim 4, further comprising:

a clamping device for holding the movable substrate.

7. The apparatus of claim 6, further comprising:

a lifting device configured to move said first, second and third slot nozzles toward and away from said damping device.

* * * * *

UNITED STATES PATENT AND TRADEMARK OFFICE

CERTIFICATE OF CORRECTION

PATENT NO. : 6,960,261 B2
APPLICATION NO. : 10/696107
DATED : November 1, 2005
INVENTOR(S) : Peter Westermann It is certified that error appears in the above-identified patent and that said Letters Patent is hereby corrected as shown below:

Column 8

Line 51, change “damping” to --clamping--.

Signed and Sealed this

Fourteenth Day of August, 2007

JON W. DUDAS
*Director of the United States Patent and Trademark Office*